US010907367B2

(12) United States Patent
Dixon

(10) Patent No.: US 10,907,367 B2
(45) Date of Patent: Feb. 2, 2021

(54) ADJUSTABLE SCAFFOLDING TUNNEL ASSEMBLY

(71) Applicant: James Dixon, South Lyon, MI (US)

(72) Inventor: James Dixon, South Lyon, MI (US)

( * ) Notice: Subject to any disclaimer, the term of this patent is extended or adjusted under 35 U.S.C. 154(b) by 0 days.

(21) Appl. No.: 16/520,442

(22) Filed: Jul. 24, 2019

(65) Prior Publication Data

US 2020/0141137 A1 May 7, 2020

Related U.S. Application Data

(60) Provisional application No. 62/755,609, filed on Nov. 5, 2018.

(51) Int. Cl.

| | |
|---|---|
| ***E04G 21/32*** | (2006.01) |
| ***E04G 1/18*** | (2006.01) |
| ***E04G 1/24*** | (2006.01) |

(52) U.S. Cl.

CPC ..... *E04G 21/3209* (2013.01); *E04G 1/18* (2013.01); *E04G 2001/242* (2013.01)

(58) Field of Classification Search

CPC ..... E04G 21/3209; E04G 21/32; E04G 2001/242; E04G 1/22; E04G 21/3204; E04G 1/18; E21D 23/0013; E21D 19/04; E21D 23/0418

USPC ..... 182/188; 52/650.3

See application file for complete search history.

(56) References Cited

U.S. PATENT DOCUMENTS

| | | | | | |
|---|---|---|---|---|---|
| 437,935 | A | * | 10/1890 | O'Brien | E04G 5/06 182/186.9 |
| 3,885,362 | A | * | 5/1975 | Pollock | E04B 1/8218 52/126.7 |
| 3,922,866 | A | * | 12/1975 | Benning | E02D 17/086 405/283 |
| 4,222,459 | A | * | 9/1980 | Hard | E04G 1/34 182/128 |
| 4,620,608 | A | | 11/1986 | Gilbreath | |
| 4,620,612 | A | * | 11/1986 | Enoki | B63C 5/02 182/113 |
| 5,054,580 | A | * | 10/1991 | Cheek | E04G 1/34 182/151 |
| 5,069,309 | A | | 12/1991 | Swiderski et al. | |
| 5,768,829 | A | * | 6/1998 | Thompson | E04B 1/34321 52/86 |
| 5,988,317 | A | | 11/1999 | Riding | |

(Continued)

*Primary Examiner* — Andrew J Triggs

(74) *Attorney, Agent, or Firm* — Boudwin Intellectual Property; Daniel Boudwin

(57) ABSTRACT

An adjustable scaffolding tunnel assembly. The assembly includes a first pair of posts connected on upper and lower portions thereof to a second pair of posts via grooved members. A first cross beam is positioned between the first pair of posts, and a second cross beam is positioned between the second pair of posts. A plurality of support beams is disposed between the first and second cross beams. The first and second pairs of posts are vertically adjustable, and the first and second cross beams and the support beams are laterally adjustable. In this manner, a height and a width of the assembly are individually adjustable. The adjustable scaffolding tunnel assembly can hold one or more isolation members, such as wood or drywall, to isolate an interior of the assembly from an exterior of the assembly.

10 Claims, 9 Drawing Sheets

(56) References Cited

U.S. PATENT DOCUMENTS

| | | | | |
|---|---|---|---|---|
| 6,119,810 | A * | 9/2000 | Harder | E04G 1/34 182/152 |
| 6,471,003 | B2 | 10/2002 | Wyse | |
| 6,832,666 | B2 | 12/2004 | Stringer | |
| 8,752,669 | B2 * | 6/2014 | Hofer | B65G 57/03 182/178.5 |
| 2009/0133354 | A1 * | 5/2009 | Spear | E04B 2/7453 52/588.1 |
| 2011/0204307 | A1 * | 8/2011 | Bowman | E04G 5/12 256/24 |
| 2012/0031017 | A1 * | 2/2012 | Stroyer | E01D 2/00 52/157 |
| 2016/0160513 | A1 * | 6/2016 | Singh | E04G 1/152 182/113 |
| 2016/0251812 | A1 * | 9/2016 | Preston | E04C 2/00 52/185 |

* cited by examiner

ADJUSTABLE SCAFFOLDING TUNNEL ASSEMBLY

CROSS REFERENCE TO RELATED APPLICATIONS

This application claims priority under 35 U.S.C. § 119(e) to U.S. Provisional Application No. 62/755,609 filed on Nov. 5, 2018. The above identified patent application is incorporated by reference herein in its entirety to provide continuity of disclosure.

BACKGROUND OF THE INVENTION

The present invention relates to an adjustable scaffolding tunnel assembly for isolating a construction workspace from a pedestrian thoroughfare, such as a hallway in an interior of a building.

Many interior construction projects occur in hallways or corridors. These projects, while necessary for maintenance or improvement of the building, often occur during times of use of the building and can cause a variety of difficulties for both construction workers and pedestrians within the building. Construction in a hallway may result in blocking off that particular hallway, or a portion thereof, from foot traffic during the construction. If the hallway is not blocked off, foot traffic may become close to tools, raw materials, and other equipment that may not be safe for many individuals to be near. The increased foot traffic near these workspaces may also slow the work of the construction workers, leading to more time spent on the project and the possibility of missing estimates due to delay. However, if the hallway is blocked off, critical routes for foot traffic may become inaccessible, and this could be inconvenient or even dangerous in certain scenarios.

Construction in a hospital includes the aforementioned challenges as well as several additional challenges. For example, all construction work must be performed in a negative pressure (i.e., vacuum) environment to prevent airborne spread of contaminants, including dirt, dust, sawdust, debris, and the like, which may otherwise spread throughout a hallway, a wing, or a building by way of ventilation systems. Because these contaminants are carriers for infectious diseases, such as bacteria and viruses, mismanagement of hospital construction may not only require clean up, but may also result in injury, illness, or even death to patients that would be attributed to the presence of contaminants in critical environments, such as patient rooms and operating rooms.

Existing solutions for isolating a construction work environment from a patient environment in a hospital include, for example, erecting drywall, such as vinyl-faced drywall, and creating an almost permanent installation to perform the construction work. Erecting and assembling drywall is both time and labor intensive, and as the work progresses, the drywall may need to be carefully disassembled without creating dust and debris, and reassembled again at a different location, which adds to the time, labor, and risk required for the project. These costs may be passed on to the hospital, which could increase overhead and the cost of care provided.

Therefore, there is a need for an adjustable scaffolding tunnel assembly for safely isolating construction activities from pedestrians nearby, which may be used in a hospital environment. The present invention addresses this unmet need.

Devices have been disclosed in the art that relate to scaffolds. These include devices that have been patented and published in patent application publications. These devices are often not configured to provide an adjustable tunnel that isolates an interior of the tunnel from an exterior of the tunnel. In view of the devices disclosed in the art, it is submitted that there is a need in the art for an improvement to existing scaffolds. In view of the present disclosure, it is submitted that the present invention substantially diverges in structural and functional elements from devices in the art, and substantially fulfills an unmet need in the art.

SUMMARY OF THE INVENTION

In view of the disadvantages inherent in the known types of scaffolds in the art, the present invention provides a new and improved adjustable scaffolding tunnel assembly, wherein the same can be utilized for isolating an interior of a tunnel from an exterior of the tunnel, such that the interior of the tunnel is sized and configured to allow pedestrian foot traffic to pass therethrough, and such that the exterior of the tunnel is sized and configured to allow construction activities to occur thereby without interfering with the pedestrian foot traffic.

It is therefore an object of the present invention to provide an adjustable scaffolding tunnel assembly for separating foot traffic from construction activities, and for isolating the construction activities from spaces nearby, for example, by application of a negative air pressure.

In one aspect, the invention provides an adjustable scaffolding tunnel assembly, comprising a plurality of posts connected by a plurality of grooved members and a plurality of cross beams. Aligned pairs of grooved members of the plurality of grooved members are configured to hold isolation members therein, and a space between a first cross beam and a second cross beam is configured to hold one or more upper isolation members therein. The posts of the plurality of posts are vertically adjustable, and the cross beams of the plurality of cross beams are laterally adjustable. In this manner, in a certain aspect, the invention provides an adjustable scaffolding tunnel assembly that is configured to form a tunnel therethrough.

In some embodiments, upon insertion of one or more isolation members into the aligned pairs of grooved members and upon insertion of the one or more upper isolation members into the space between the first cross beam and the second cross beam, the tunnel is formed within the assembly. In this manner, the tunnel is sized and configured to enable one or more individuals to pass therethrough and is isolated from an exterior of the assembly.

In some embodiments, a lower end of each post of the plurality of posts includes a wheel attached thereto, such that the assembly is capable of rolling on a surface thereunder for easy transport. In some embodiments, the wheel is a castor wheel, and in this manner the assembly is capable of rotating and rolling on the surface thereunder.

In another aspect, the invention provides an adjustable scaffolding tunnel assembly, comprising a first post, a second post, a third post, and a fourth post. The assembly further comprises a first lower grooved member that connects the first post to the third post at lower portions thereof, a second lower grooved member that connects the second post to the fourth post at lower portions thereof, a first upper grooved member that connects the first post to the third post at upper portions thereof, and a second upper grooved member that connects the second post to the fourth post at upper portions thereof. A first cross beam that connects the first post to the second post at upper portions thereof is included with a second cross beam that connects the third post to the fourth post at upper portions thereof. Similarly, the first post, the second post, the third post, and the fourth post are vertically adjustable, and the first cross beam and the second cross beam are laterally adjustable.

In some embodiments, upon insertion of a first isolation member into the first lower grooved member and the first upper grooved member, insertion of a second isolation member into the second lower grooved member and the second upper grooved member, and insertion of one or more upper isolation members into a space between the first cross beam and the second cross beam, a tunnel is formed within the assembly. The tunnel may be sized and configured to enable one or more individuals to pass therethrough and be isolated from an exterior of the assembly.

In some embodiments, a lower end of each of the first post, the second post, the third post, and the fourth post includes a wheel attached thereto, such that the assembly is capable of rolling on a surface thereunder. In some embodiments, the wheel is a castor wheel, such that the assembly is capable of rotating and rolling on the surface thereunder.

In various embodiments, one or more connections of the present invention are reversible. The reversible connections enable the components of the assembly to be more compact when not in use, and in this manner, the assembly may be stored or transported, in addition, the assembly may be assembled and disassembled quickly and easily.

Another object of the present invention is to provide an adjustable scaffolding tunnel assembly that may be readily manufactured from materials that permit relative economy and are commensurate with durability. In some embodiments, one or more components of the adjustable scaffolding tunnel assembly may be comprised of steel, such as a lighter steel, or aluminum. In this manner, storage and transport of the assembly when not in use is facilitated.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
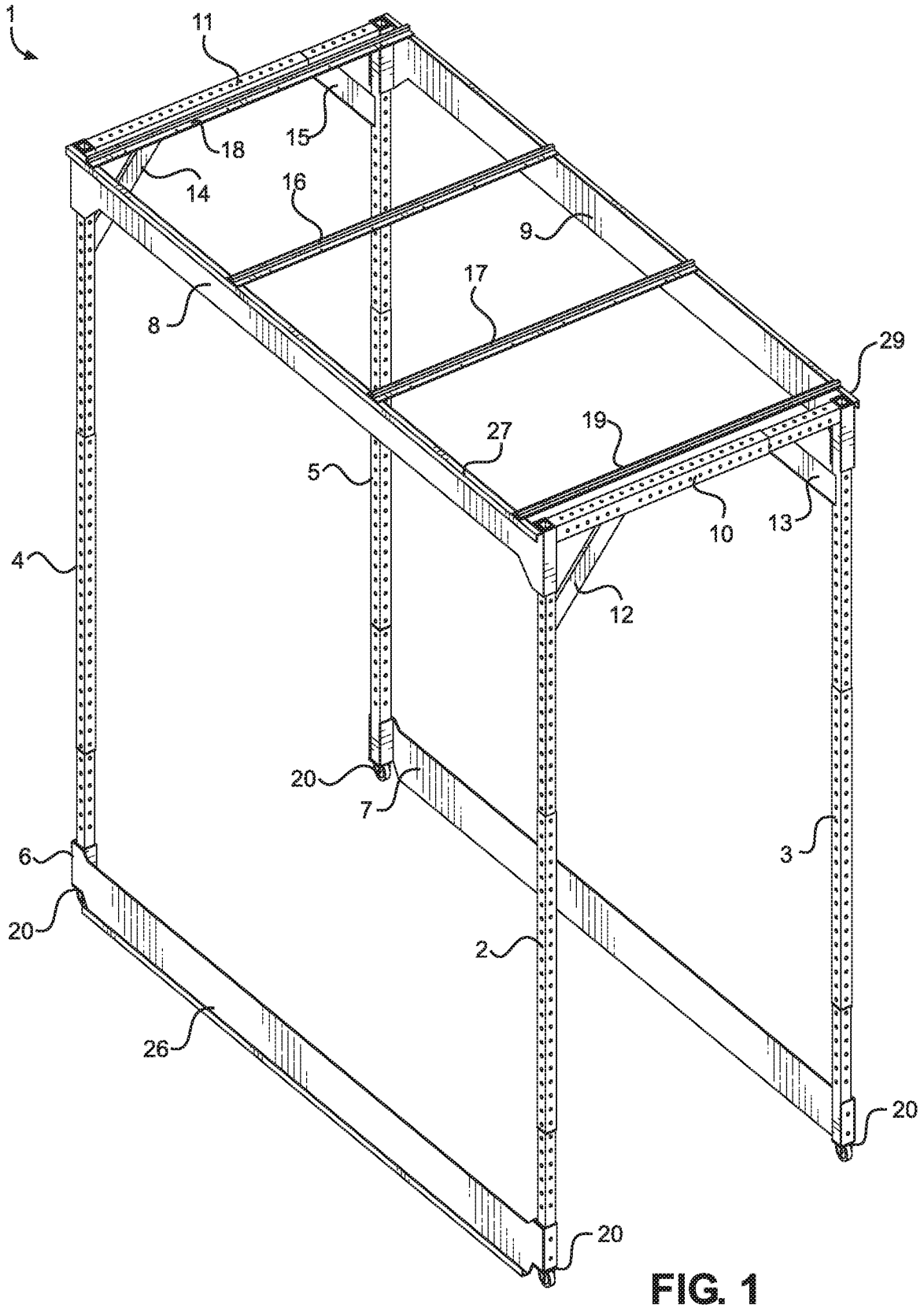
FIG. 1 depicts a perspective view of an exemplary adjustable scaffolding tunnel assembly, according to the present invention.

Reference is made herein to the attached drawings. Like reference numerals are used throughout the drawings to depict like or similar elements of the invention. The figures are intended for representative purposes only and should not be considered limiting in any respect.

Reference is now made to the drawings, which depict one or more exemplary embodiments of the invention.

Referring now to FIG. 1, there is depicted a perspective view of an exemplary adjustable scaffolding tunnel assembly, according to the present invention. An adjustable scaffolding tunnel assembly 1 includes a plurality of posts (2, 3, 4, 5) connected by a plurality of grooved members (6, 7, 8, 9) and a plurality of cross beams (10, 11). Aligned pairs of grooved members (6, 8) and (7, 9) of the plurality of grooved members are configured to hold isolation members, such as pieces of wood or drywall, such as vinyl-faced drywall, as described elsewhere herein. In addition, a space between a first cross beam 10 and a second cross beam 11 is configured to hold one or more upper isolation members, such as pieces of wood or drywall, such as vinyl-faced drywall, as described elsewhere herein. Generally, the posts of the plurality of posts (2, 3, 4, 5) are vertically adjustable such that an individual can adjust a height of the assembly, and the cross beams of the plurality of cross beams (10, 11) are laterally adjustable such that the individual can adjust a width of the assembly. In this manner, the assembly can be adjusted and configured for use in a wider or a narrower hallway, according to need for a particular scenario.

In the shown embodiment, a plurality of support braces (12, 13, 14, 15) is affixed to the plurality of posts (2, 3, 4, 5) and the plurality of cross beams (10, 11). The plurality of support braces acts to reinforce the joints between the posts and the cross beams, such that lateral forces which may otherwise bend these joints are not able to bend these joints. The plurality of support braces (12, 13, 14, 15) includes a first support brace 12 positioned about a joint between a first post 2 and the first cross beam 10, a second support brace 13 positioned about a joint between a second post 3 and the first cross beam 10, a third support brace 14 positioned about a joint between a third post 4 and the second cross beam 11, and a fourth support brace 15 positioned about a joint between a fourth post 5 and the second cross beam 11. In this manner, all posts of the plurality of posts (2, 3, 4, 5) are supported by the plurality of support braces (12, 13, 14, 15).

In the shown embodiment, a plurality of support beams (16, 17, 18, 19) are placed on top of the upper grooved members (8, 9). The support beams of the plurality of support beams (16, 17, 18, 19) may not be configured to hold or support a substantial weight placed thereon, but may be configured to hold a plurality of upper isolation members therein to form a tunnel of the assembly. In this manner, the tunnel of the assembly includes sidewalk and a ceiling (i.e., the bottoms of the support beams of the plurality of support beams), as described elsewhere herein.

In the shown embodiment, the grooved members of the plurality of grooved members (6, 7, 8, 9) each includes a groove thereon, such as a J-groove, configured to hold a planar item therein, such as a wooden board or a piece of drywall, such as vinyl-faced drywall (e.g., an isolation member). In various embodiments, vinyl-faced drywall may be advantageous for use due to the need to tape and sand the material before, during, or after use. The isolation member slips into the groove the J-groove), and is held in place by the groove. For example, an isolation member placed on a first lower grooved member 6 slips into a groove formed by a lip 26 which extends outward and up from a lower portion of the first lower grooved member 6, and also fits into a lip 27 of a first upper grooved member 8, as described elsewhere herein. Similarly, a second upper grooved member 9 includes a lip 29 thereon, and a second lower grooved member 7 includes a lip thereon for the same purpose. In this manner, a tunnel may be effectively formed to enable foot traffic to pass through the tunnel during use of the assembly at a construction site.

In the shown embodiment, the assembly includes a plurality of wheels 20, e.g., castor wheels 20, positioned at lower ends of each post of the plurality of posts (2, 3, 4, 5). The wheels 20 are configured to enable the assembly 1 to roll along a surface thereunder. In the case of castor wheels, the assembly 1 can also rotate, in addition to rolling. In this manner, once assembled at a first location on the surface thereunder, the assembly 1 may be rolled to a desired location for a particular use, e.g., a construction activity.

Figure 2:
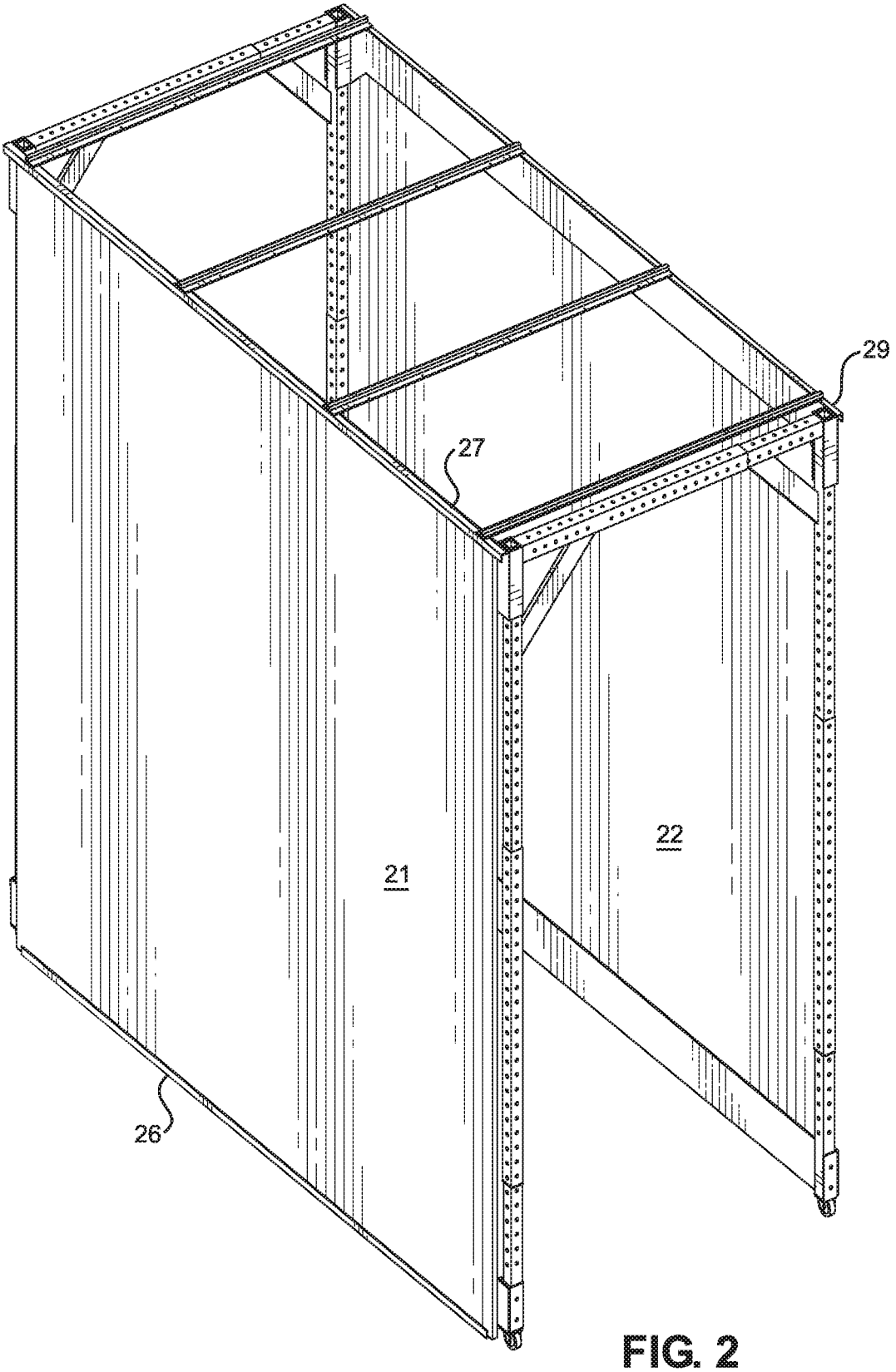
FIG. 2 depicts a perspective view of the assembly, with a first isolation member and a second isolation member inserted therein.
Figure 3:
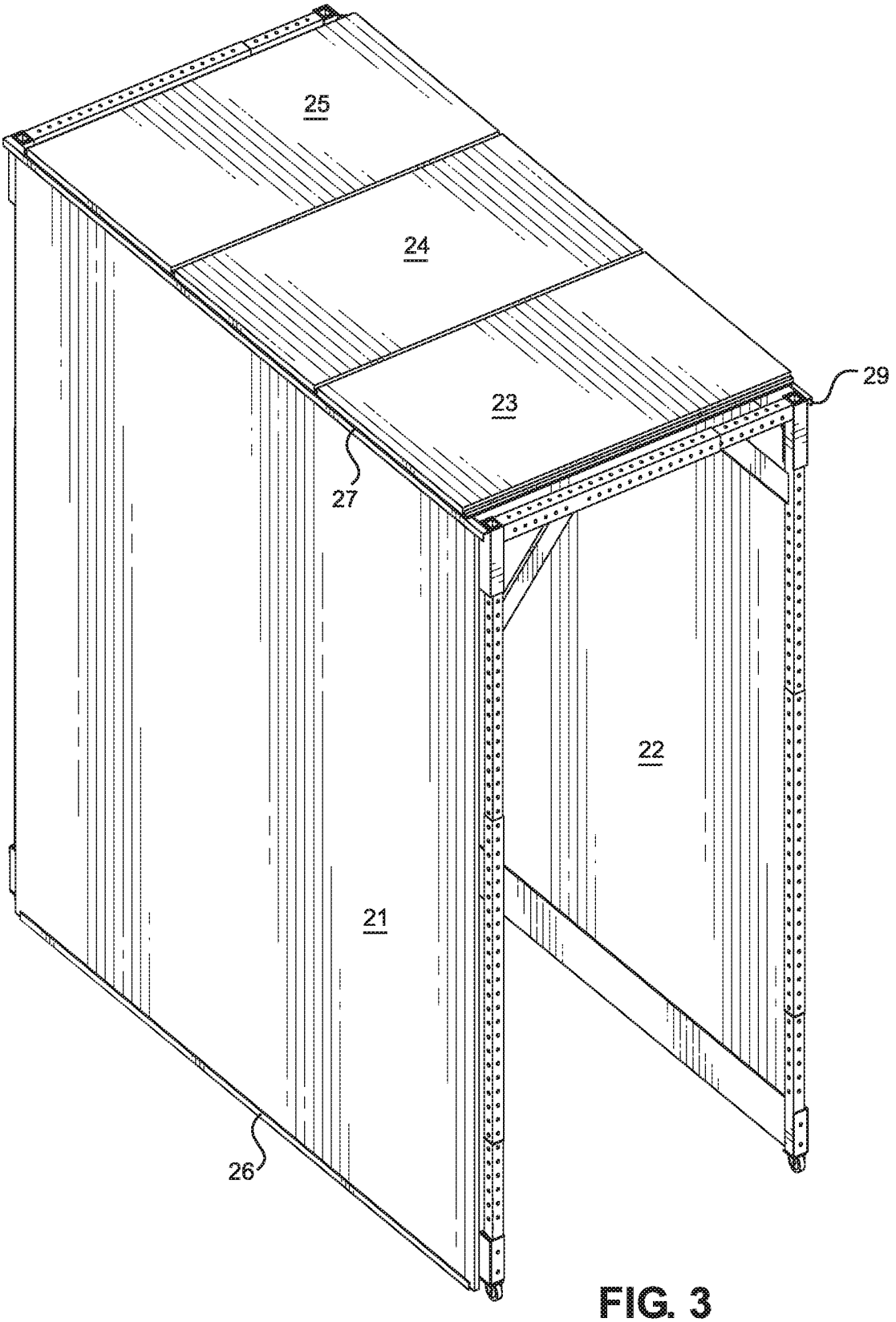
FIG. 3 depicts a perspective view of the assembly, with the first isolation member, the second isolation member, and a plurality of upper isolation members inserted therein, to form a tunnel.

Referring now to FIGS. 2 and 3, there are depicted perspective views of the assembly, with a first isolation member and a second isolation member inserted therein (FIG. 2) and additionally with a plurality of upper isolation members inserted therein (FIG. 3). In the shown embodiment, a first isolation member 21 is resting on lip 26 of the first lower grooved member, and is held in place by both lip 26 of the first lower grooved member and lip 27 of the first upper grooved member. In addition, in the shown embodiment, a second isolation member 22 is resting on a lip of the second lower grooved member and is held in place by both the lip of the second lower grooved member and lip 29 of the second upper grooved member. In this manner, the sidewalls of a tunnel of the assembly are formed. In addition, in the embodiment of FIG. 3, the ceiling of the tunnel of the assembly is formed. The ceiling is comprised of lower surfaces of the upper isolation members of the plurality of upper isolation members (23, 24, 25). In this manner, the tunnel of the assembly is completely formed and ready for use.

To utilize the tunnel of the assembly, it may be desirable to provide a negative air pressure work environment for construction activities. This may be necessary if working in a hospital or other sensitive environment. Such a negative air pressure may be created by forming one or more isolated environments around a space external to the tunnel of the assembly. The isolated environment may be comprised of an air-tight seal, as may be formed between a plastic sheet and portions of the assembly of the present invention. For example, plastic sheets may be taped or otherwise secured to the posts and/or isolation members of the assembly, and then taped or otherwise secured to nearby structures, such as walls, of the corridor or workspace. In this manner, the assembly of the present invention may be used in combination with one or more sheets, such as one or more plastic sheets, to form an air-tight space. Once the air-tight space is formed, a negative pressure may be applied and maintained by use of vacuum technology according to a particular need.

Figure 4:
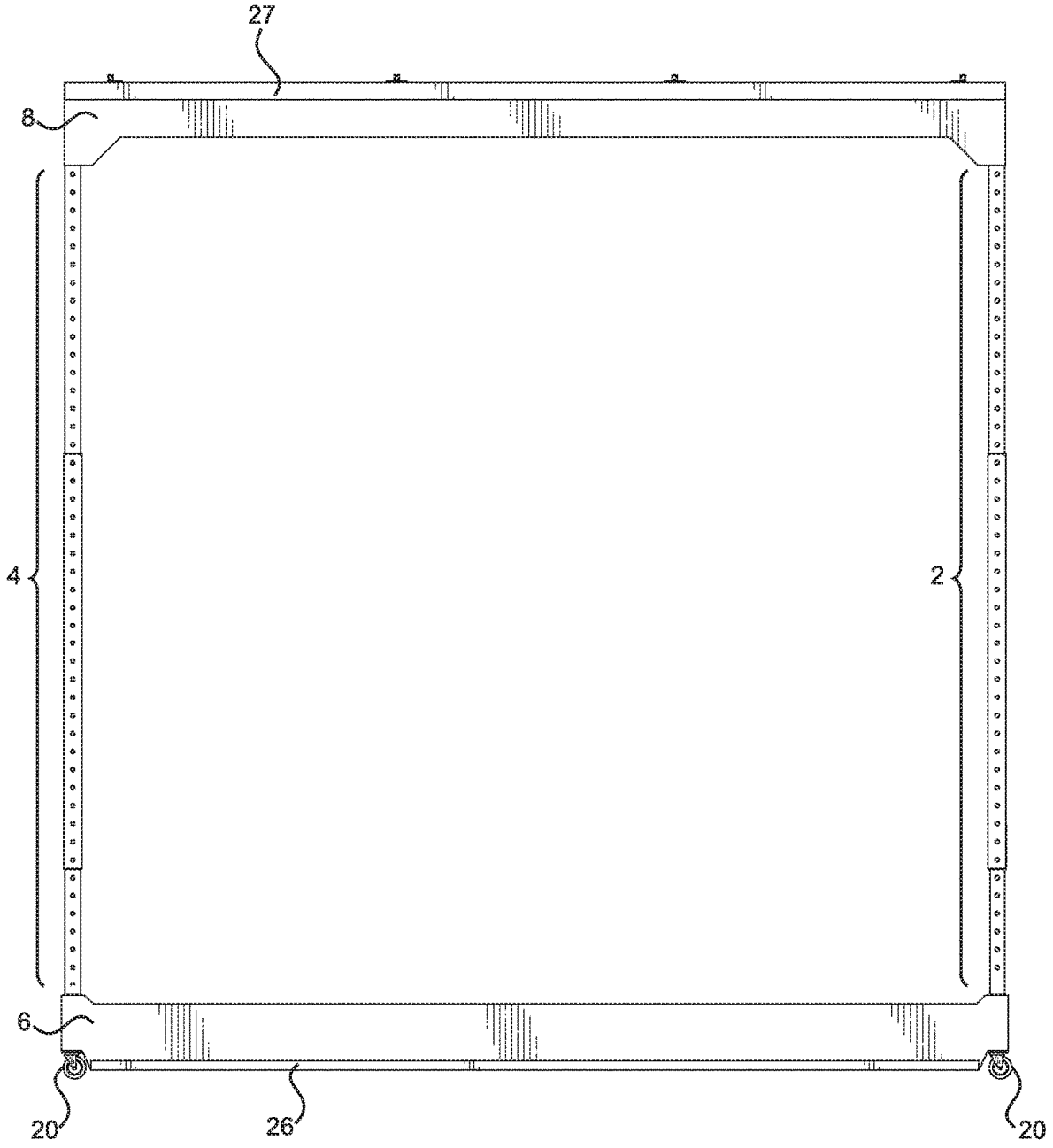
FIG. 4 depicts a side elevated view of the assembly.
Figure 5:
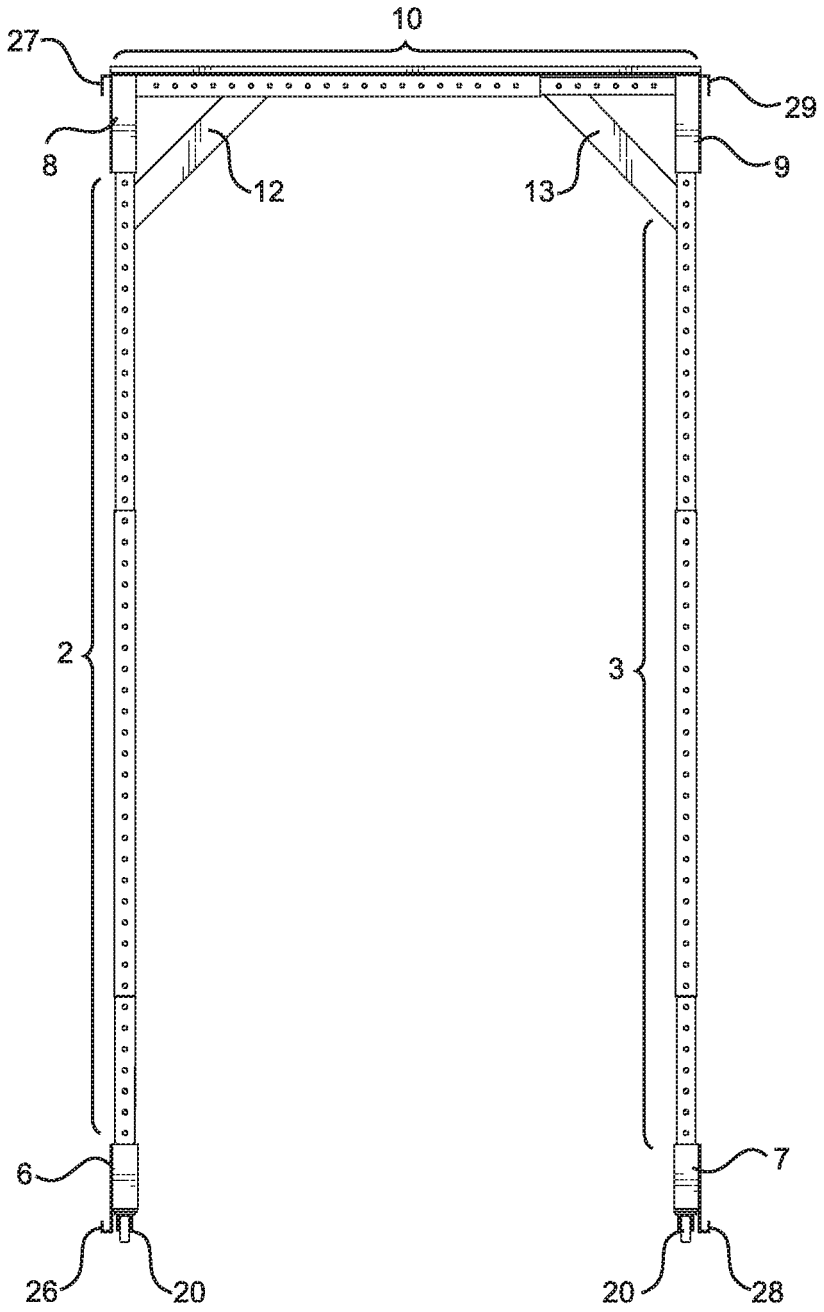
FIG. 5 depicts a front elevated view of the assembly.

Referring now to FIGS. 4, and 5, there are depicted a side elevated view (FIG. 4) and a front elevated view (FIG. 5) of the assembly. In the shown embodiment, the first post 2 and the second post 3 are extended to form a height which is equal to a height of the third post 4 and the fourth post. The height of each of these posts is adjustable, and may be increased or decreased as needed by a telescopic mechanism described elsewhere herein. In this manner, the assembly may be used in hallways or workspaces having any of a variety of different shapes or measurements. In the shown embodiment, the first lower grooved member 6 includes the lip 26 thereon, and this lip 26 aligns with the lip 27 of the first upper grooved member 8 to hold and secure an isolation member therein. Similarly, the second lower grooved member 7 includes the lip 28 thereon, and this lip 28 aligns with the lip 29 of the second upper grooved member 9 to hold and secure an isolation member therein. In this manner, it is contemplated that the isolation members be sized to fit, e.g., fit snugly, into the lips (26, 27) and (28, 29) such that there is little or no space left uncovered by the isolation member. In some embodiments, a height of lower lips (26, 28) may be one inch, and a height of upper lips (27, 29) may be two inches. In this manner, the isolation member, such as vinyl-faced drywall, may easily be inserted to rest on either of the lower lips (26, 28) with either of the upper lips (27, 29) holding it in place. Accordingly, the isolation member may be sized according to a desired size of the assembly. The first cross beam 10 and the second cross beam each also includes a telescopic mechanism thereon, and the width of the cross beams is adjustable to change the width of the assembly. In the shown embodiment, the first support brace 12 is positioned about the joint between the first post 2 and the first cross beam 10, and the second support brace 13 is positioned about the joint between the second post 3 and the first cross beam 10. In this manner, the assembly is stabilized from lateral movements that may otherwise strain these joints.

Figure 6:
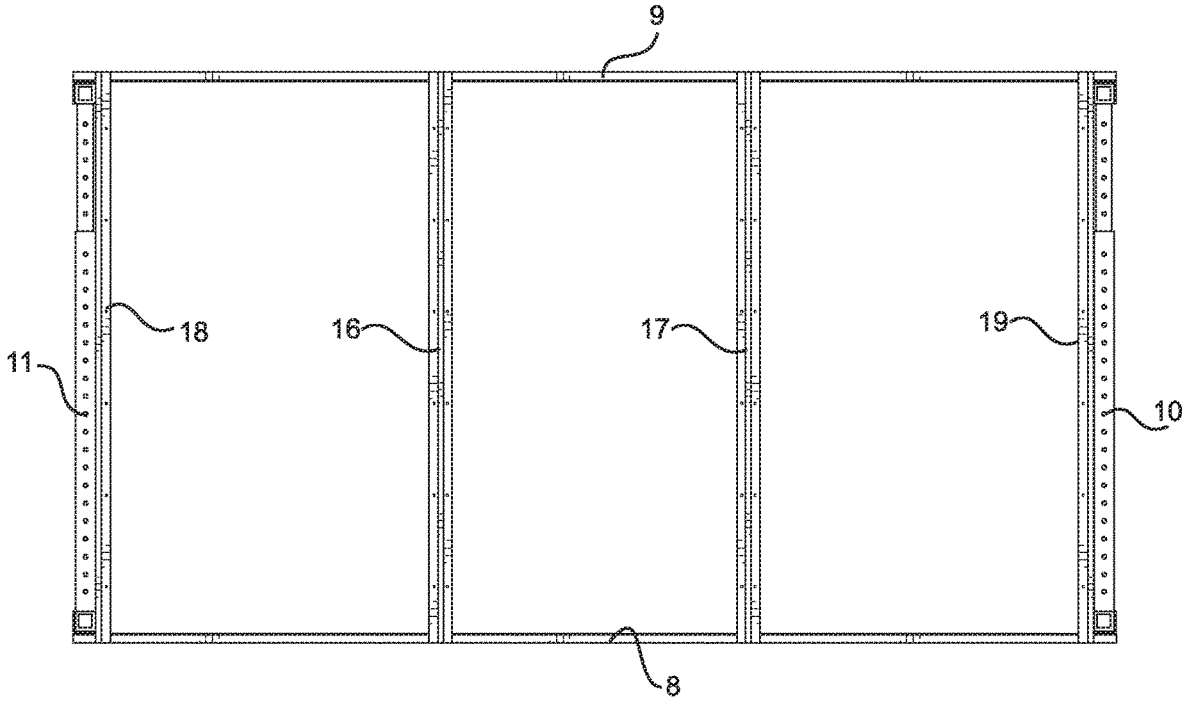
FIG. 6 depicts a top elevated view of the assembly.

Referring now to FIG. 6, there is depicted a top elevated view of the assembly. In the shown embodiment, the first cross beam 10 includes the telescopic mechanism thereon for adjustment of the width of the assembly, and the second cross beam 11 also includes the telescopic mechanism thereon for the same purpose. Generally, the telescopic mechanism of the present invention includes a first member in mating engagement with a second member, and each of the first member and the second member includes a plurality of apertures thereon, the apertures regularly spaced. In this manner, an aperture of the first member is aligned with an aperture of the second member, and the aligned apertures secured in place by a key member (e.g., a pin), such as a cylindrical key member, to lock the first member and the second member in place and prevent unwanted sliding movements during use of the assembly.

In the shown embodiment, the plurality of support beams (16, 17, 18, 19) includes a first support beam 16, a second support beam 17, a third support beam 18, and a fourth support beam 19. The third support beam 18 is adjacent the second cross beam 11, and the fourth support beam 19 is adjacent the first cross beam 10, while the first and second support beams (16, 17) occupy medial spaces along a length of the assembly, in the shown embodiment, the upper grooved members (8, 9) are fixed in length, such that they may not be generally adjustable. In this manner, in the exemplary embodiment, the assembly may be adjusted by width and height, but may not necessarily be adjusted by length. In the shown embodiment, the support beams (16, 17, 18, 19) are not adjustable, but rather fixed in length. In this manner, if the width of the assembly is adjusted by adjusting the widths of the cross beams (10, 11), a separate set of support beams (16, 17, 18, 19) may be needed to fit the different width. In various embodiments, the support beams (16, 17, 18, 19) are reversibly attached or engaged with the cross beams (10, 11) and may be interchanged with alternate support beams as needed to fit the chosen width.

Figure 7:
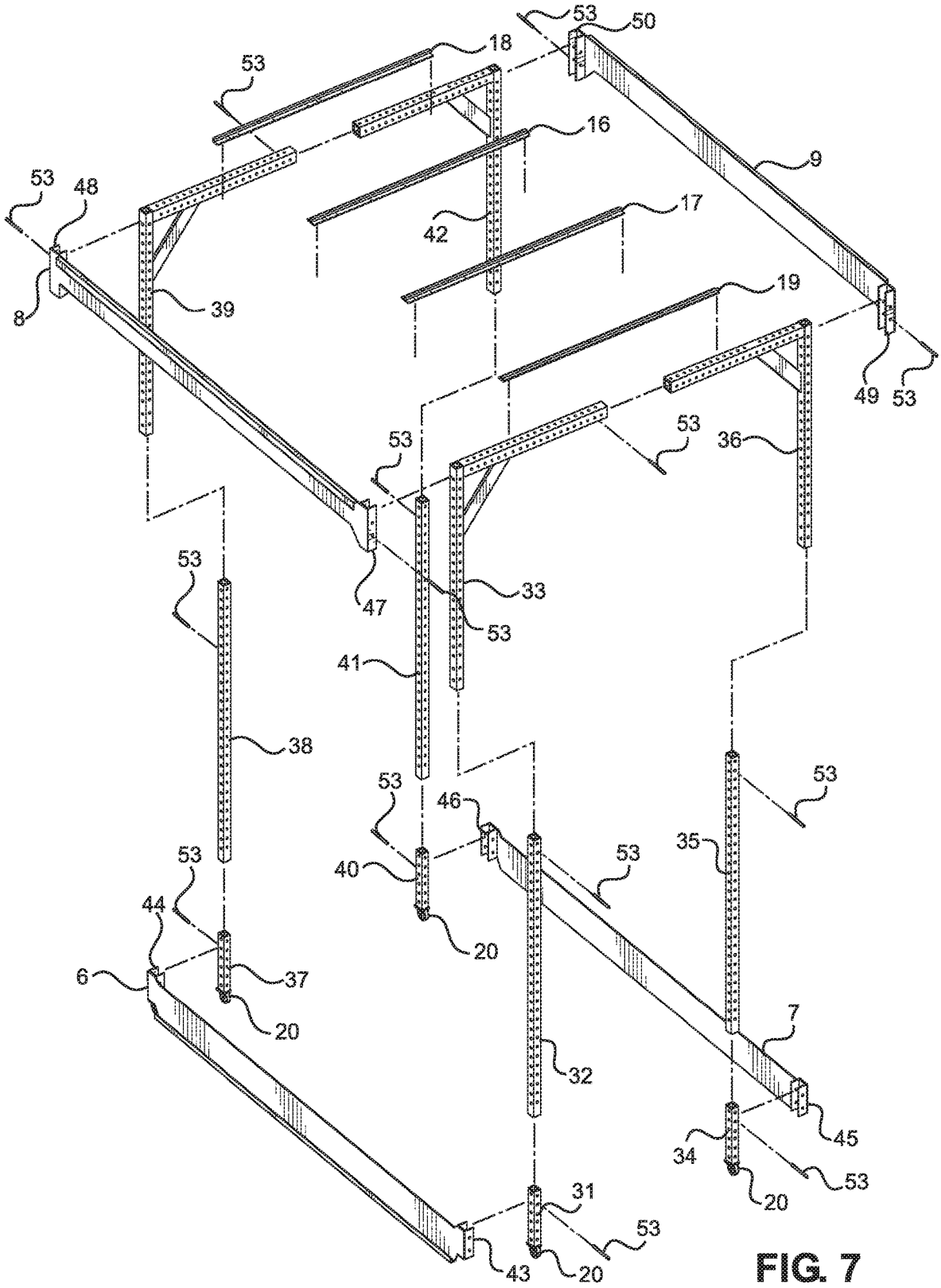
FIG. 7 depicts an exploded view of the assembly.

Referring now to FIG. 7, there is depicted an exploded view of the assembly. In the shown embodiment, the posts are each comprised of lower members (31, 34, 37, 40), medial members (32, 35, 38, 41), and corner members (33, 36, 39, 42), the latter of which also form parts of the first and second cross beams. The lower members (31, 34, 37, 40) each includes the castor wheel 20 thereon. An upper end of each of the lower members (31, 34, 37, 40) slides into a lower end of the medial members (32, 35, 38, 41), and a lower end of the corner members (33, 36, 39, 42) slides into an upper end of the medial members (32, 35, 38, 41). The member-member interactions are securable in place by aligning apertures and inserting a locking member 53, such as a cylindrical bar or pin 53, through the aligned apertures.

In the shown embodiment, the first lower grooved member 6 includes a first bracket 43 and a second bracket 44, which reversibly engage with the lower members (31, 37) of the first and third posts, respectively. Similarly, the second lower grooved member 7 includes a first bracket 45 and a second bracket 46, which reversibly engage with the lower members (34, 40) of the second and fourth posts, respectively. In addition, the first upper grooved member 8 includes a first bracket 47 and a second bracket 4, which reversibly engage with the corner members (33, 39) of the first and third posts, respectively. Similarly, the second upper grooved member 9 includes a first bracket 49 and a second bracket 50, which reversibly engage with the corner members (36, 42) of the second and fourth posts, respectively. In this manner, the assembly may be completely assembled or completely disassembled according to need. The assembly may be assembled for use, and disassembled for storage or transport.

Figure 8:
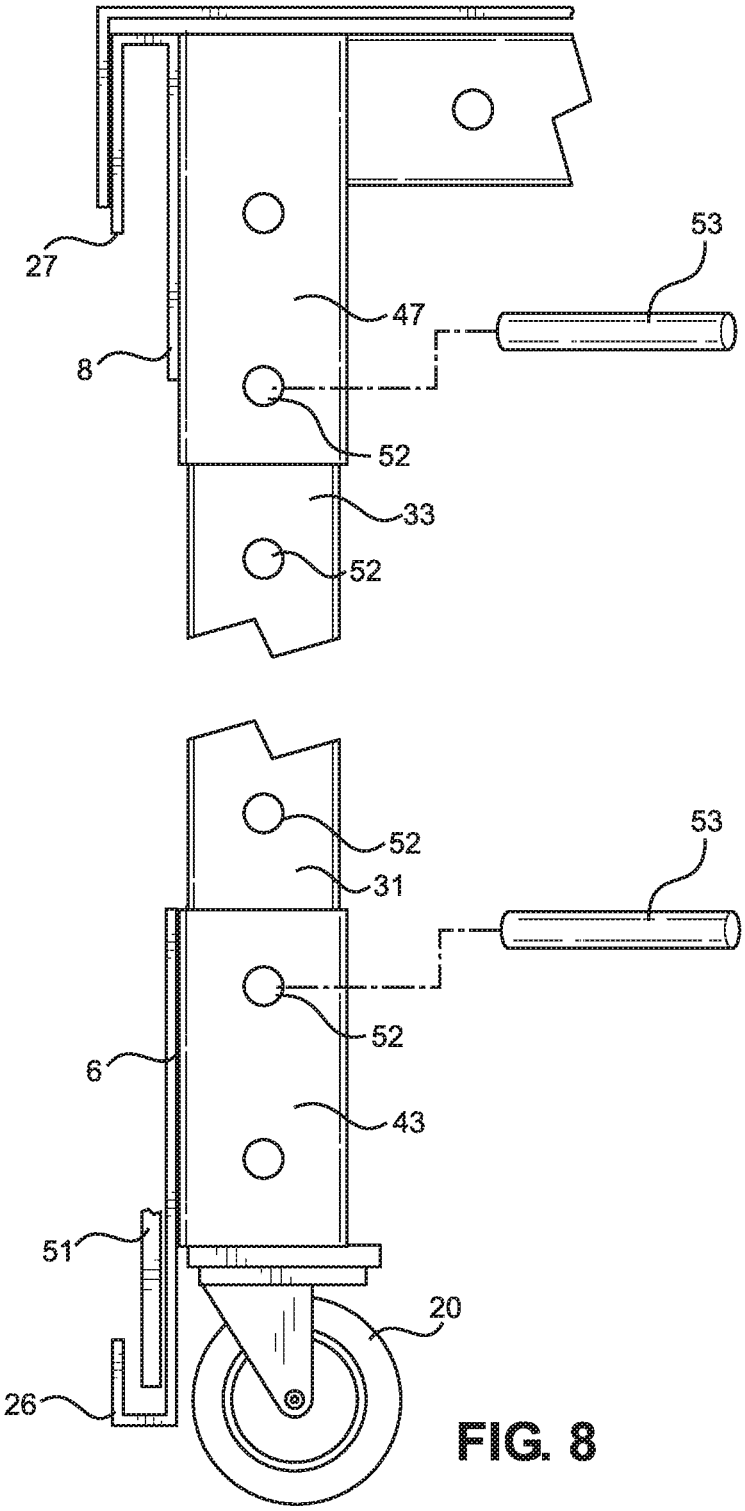
FIG. 8 depicts a close-up front elevated view of a first lower grooved member and a first upper grooved member configured to hold a first isolation member therein.

Referring now to FIG. 8, there is depicted a close-up front elevated view of a first lower grooved member and a first upper grooved member configured to hold a first isolation member therein. The first post is shown broken to emphasize features of the grooved members. In the shown embodiment, the lower member 31 of the first post includes a plurality of apertures 52 therethrough, and the castor wheel 20 on a lower end thereof. The apertures 52 are regularly spaced, and like all apertures of the structures of the invention, are configured to receive a securement member, such as a locking pin 53, therethrough to isolate two or more members with respect to each other. In addition, the corner member 33 of the first post includes the plurality of apertures 52 therethrough, also regularly spaced. The first lower grooved member 6 includes a lip 26, such as a J-shaped lip 26, configured to hold an isolation member 51 therein. The first upper grooved member 8 includes a lip 27, such as a J-shaped lip 27, configured to hold the isolation member 51 therein. In the shown embodiment, the grooves of the grooved members (6, 8) align such that the isolation member 51 is inserted and aligned to form an isolated tunnel within the assembly.

Figure 9A:
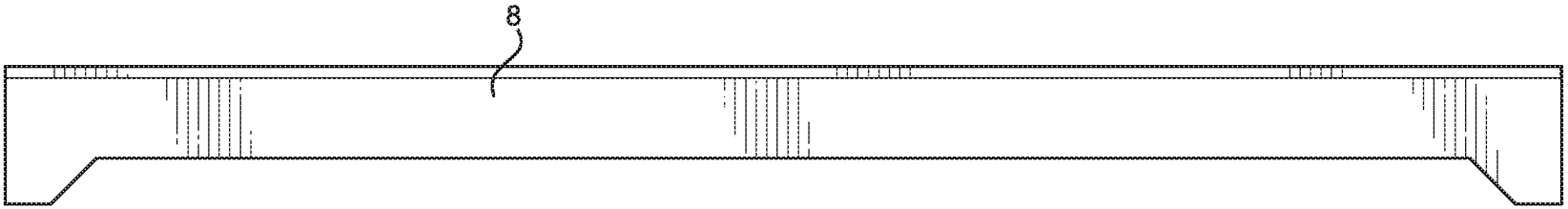
FIG. 9A depicts a side elevated view of the first upper grooved member.
Figure 9B:
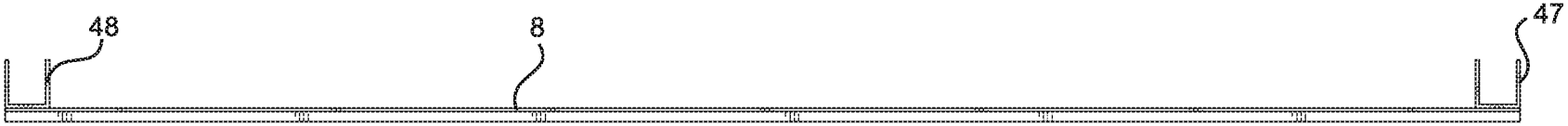
FIG. 9B depicts a top elevated view of the first upper grooved member.

Referring now to FIGS. 9A and 9B, there are depicted a side elevated view (FIG. 9A) and a top elevated view (FIG. 9B) of the first upper grooved member. The first upper grooved member 8 includes the first bracket 47 and the second bracket 48 thereon, configured to reversibly engage with the first post and the third post, respectively. The brackets (47, 48) are sized to fit over a portion of the corner members of the first and third posts, and include apertures that align to lock the first upper grooved member 8 in place.

Figure 10:
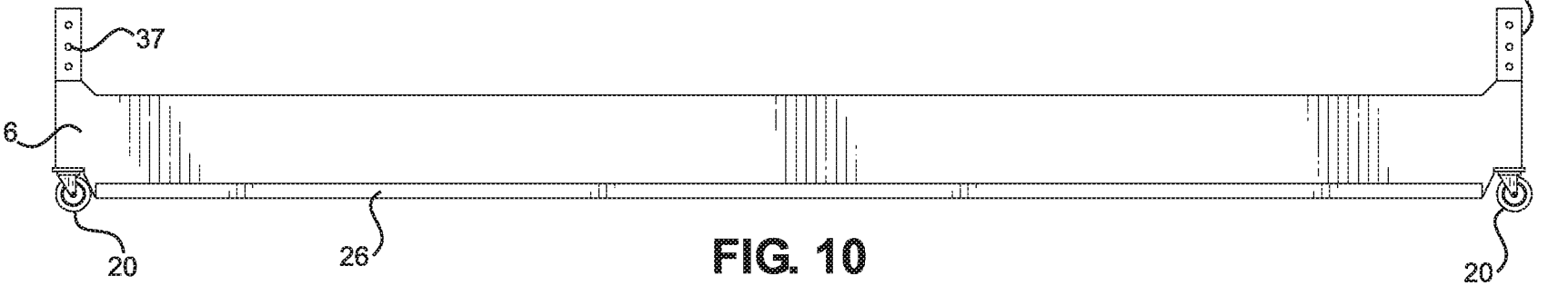
FIG. 10 depicts a side elevated view of the first lower grooved member.

Referring now to FIG. 10, there is depicted a side elevated view of the first lower grooved member, attached to lower members (31, 37) of the first and third posts, respectively. In the shown embodiment, the first and second lower grooved members each include a pair of angled cutout portions, adjacent the castor wheels 20, configured to allow the castor wheels 20 freedom of rotation in all directions. In this manner, the castor wheels 20 are not caught on the first and second lower grooved members. In the shown embodiment, the first lower grooved member 6 includes the lip 26 thereon, wherein the lip defines a groove of the lower grooved member 6 which is configured to hold an isolation member therein.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. An adjustable scaffolding tunnel assembly, comprising:

a plurality of posts connected by a plurality of grooved members and a plurality of cross beams;

wherein aligned pairs of grooved members of the plurality of grooved members are configured to hold isolation members therein;

wherein the aligned pairs of grooved members comprise a pair of upper grooved members and a pair of lower grooved members;

wherein the pair of upper grooved members each comprises an upper lip in a downward orientation;

wherein the pair of lower grooved members each comprises a lower lip in an upward orientation;

wherein the upper lip and the lower lip of a first side are configured to receive a first isolation member of said isolation members therein;

wherein the upper lip and the lower lip of a second side are configured to receive a second isolation member of said isolation members therein;

wherein a space between a first cross beam of the plurality of cross beams and a second cross beam of the plurality of cross beams is configured to hold one or more upper isolation members therein;

wherein the plurality of posts are vertically adjustable;

wherein the plurality of cross beams are laterally adjustable.

2. The assembly of claim 1, wherein said first and second isolation members each comprise one or more isolation members, wherein a tunnel is formed within the assembly.

3. The assembly of claim 2, wherein the tunnel is sized to enable one or more individuals to pass therethrough.

4. The assembly of claim 1, wherein a lower end of each post of the plurality of posts includes a wheel attached thereto, such that the assembly is capable of rolling on a surface thereunder.

5. The assembly of claim 4, wherein the wheel is a castor wheel, such that the assembly is capable of rotating and rolling on the surface thereunder.

6. An adjustable scaffolding tunnel assembly, comprising:

a first post, a second post, a third post, and a fourth post;

a first lower grooved member that connects the first post to the third post at lower portions thereof;

a second lower grooved member that connects the second post to the fourth post at lower portions thereof;

a first upper grooved member that connects the first post to the third post at upper portions thereof;

a second upper grooved member that connects the second post to the fourth post at upper portions thereof;

wherein the first upper grooved member and the second upper grooved member each comprises an upper lip in a downward orientation;

wherein the first lower grooved member and the second lower grooved member each comprises a lower lip in an upward orientation;

wherein the upper lip and the lower lip of a first side of the tunnel assembly are configured to receive a first isolation member therein;

wherein the upper lip and the lower lip of a second side of the tunnel assembly are configured to receive a second isolation member therein;

a first cross beam that connects the first post to the second post at upper portions thereof;

a second cross beam that connects the third post to the fourth post at upper portions thereof;

wherein the first post, the second post, the third post, and the fourth post are vertically adjustable;

wherein the first cross beam and the second cross beam are laterally adjustable.

7. The assembly of claim 6, further comprising one or more upper isolation members in a space between the first cross beam and the second cross beam, wherein a tunnel is formed within the assembly.

8. The assembly of claim 7, wherein the tunnel is sized to enable one or more individuals to pass therethrough.

9. The assembly of claim 6, wherein a lower end of each of the first post, the second post, the third post, and the fourth post includes a wheel attached thereto, such that the assembly is capable of rolling on a surface thereunder.

10. The assembly of claim 9, wherein the wheel is a castor wheel, such that the assembly is capable of rotating and rolling on the surface thereunder.

* * * * *